US007715757B2

(12) United States Patent
Tanaka et al.

(10) Patent No.: US 7,715,757 B2
(45) Date of Patent: May 11, 2010

(54) PULLOUT UNIT AND IMAGE FORMING DEVICE

(75) Inventors: Hiroyuki Tanaka, Kanagawa (JP); Makio Uehara, Kanagawa (JP); Osamu Uto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 206 days.

(21) Appl. No.: 11/783,822

(22) Filed: Apr. 12, 2007

(65) Prior Publication Data

US 2008/0075503 A1 Mar. 27, 2008

(30) Foreign Application Priority Data

Sep. 27, 2006 (JP) ..... 2006-262730

(51) Int. Cl.
*G03G 21/00* (2006.01)

(52) U.S. Cl. ..... 399/124; 399/21; 399/110; 271/264; 271/162

(58) Field of Classification Search ..... 399/124, 399/110, 21, 364
See application file for complete search history.

(56) References Cited

U.S. PATENT DOCUMENTS 5,840,003 A * 11/1998 Meetze et al. ..... 493/405
6,145,828 A * 11/2000 Arai ..... 271/3.03
6,647,243 B2 * 11/2003 Sato et al. ..... 399/407
6,674,983 B2 1/2004 Enomoto et al. ..... 399/124
6,799,008 B1 * 9/2004 Lim ..... 399/124
2004/0052561 A1 3/2004 Ouchi
2005/0047827 A1 * 3/2005 Komoda et al. ..... 399/124

FOREIGN PATENT DOCUMENTS

CN 1483591 3/2004
JP 2004-69770 3/2004
JP 2006-227464 A 8/2008

* cited by examiner

*Primary Examiner*—David M Gray
*Assistant Examiner*—Roy Yi
(74) *Attorney, Agent, or Firm*—Morgan, Lewis & Bockius LLP

(57) ABSTRACT

A pullout unit including a pullout component that is provided at a main body of a device so as to be able to be pulled out from the main body of the device, and that faces a conveying route surface of the main body of the device to form a conveying route on which an object to be conveyed is conveyed, and a scraping member that is provided at the pullout component at the inner side in a pullout direction in which the pullout component is pulled out, and that scrapes the object to be conveyed on the conveying route surface when the pullout component is pulled out, is provided.

20 Claims, 7 Drawing Sheets

PULLOUT UNIT AND IMAGE FORMING DEVICE

CROSS-REFERENCE TO RELATED APPLICATION

This application is based on and claims priority under 35 USC 119 from Japanese Patent Application No. 2006-262730 filed Sep. 27, 2006.

BACKGROUND

Technical Field

The present invention relates to a pullout unit and an image forming device.

SUMMARY

An aspect of the present invention is a pullout unit including: a pullout component that is provided at a main body of a device so as to be able to be pulled out from the main body of the device, and that faces a conveying route surface of the main body of the device to form a conveying route on which an object to be conveyed is conveyed; and a scraping member that is provided at the pullout component at the inner side in a pullout direction in which the pullout component is pulled out, and that scrapes the object to be conveyed on the conveying route surface when the pullout component is pulled out.

BRIEF DESCRIPTION OF THE DRAWINGS

Exemplary embodiments of the present invention will be described in detail with reference to the following figures, wherein.

DETAILED DESCRIPTION

Hereafter, an example of an exemplary embodiment according to the present invention will be explained based on the drawings.

Figure 1:
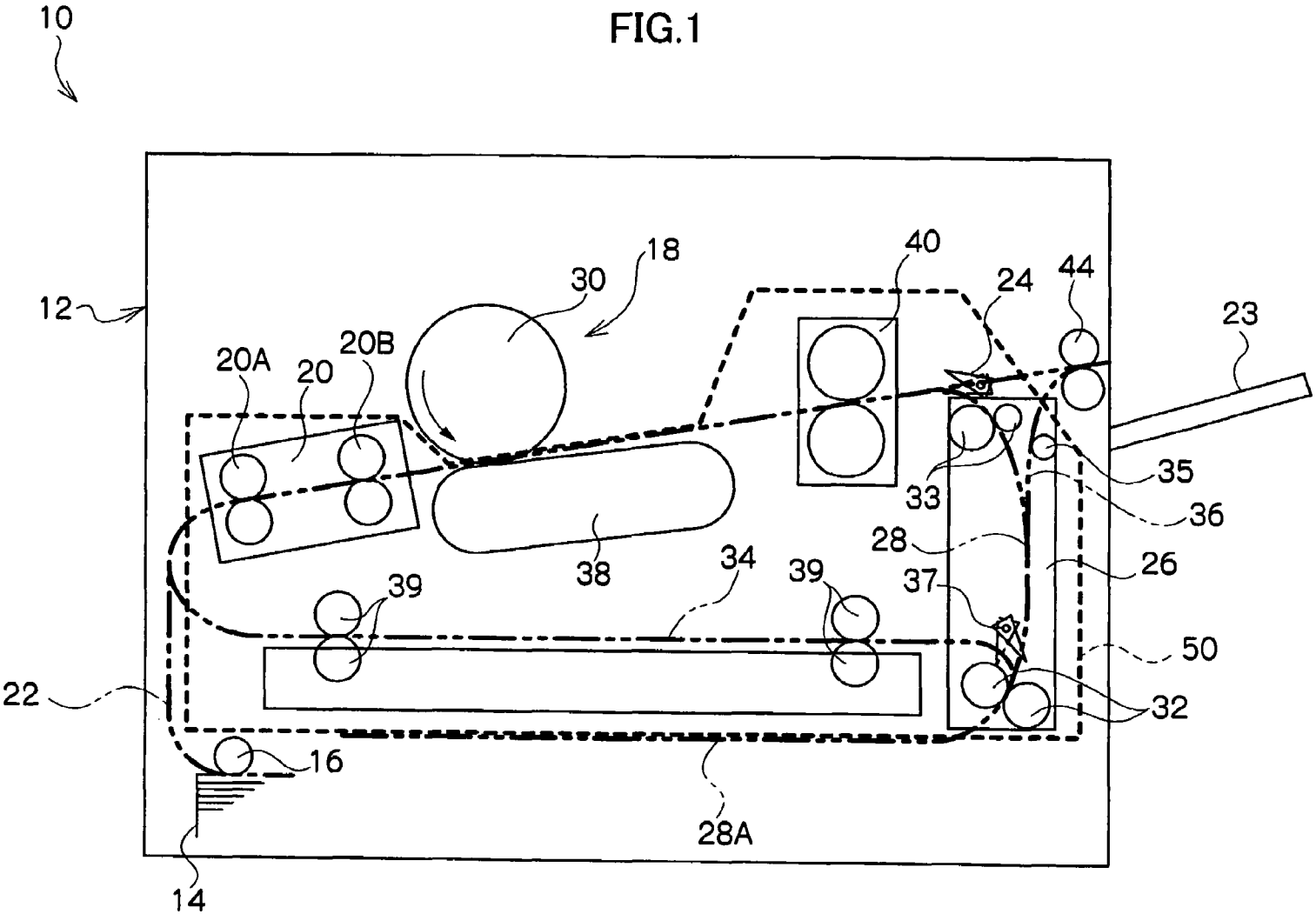
FIG. 1 is an outline drawing showing the overall configuration of the image forming device according to an exemplary embodiment of the present invention.
Figure 2:
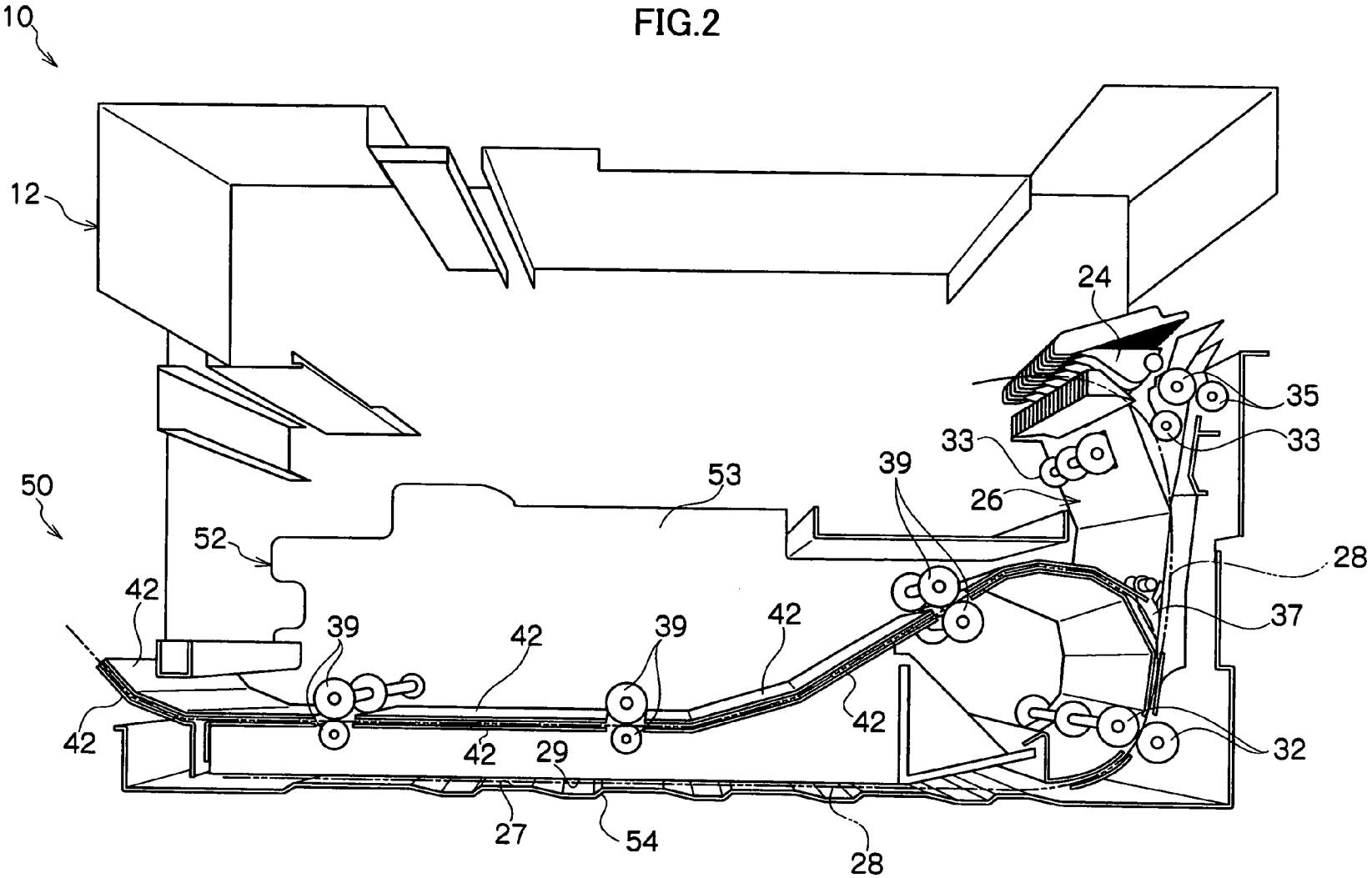
FIG. 2 is a perspective drawing showing a part of the structural components of the image forming device according to the present exemplary embodiment.

Overall Configuration of the Image Forming Device According to the Present Exemplary Embodiment First, explanations on the overall configuration of the image forming device according to the present exemplary embodiment will be explained. In FIG. 1, the overall configuration of the image forming device according to the present exemplary embodiment is shown as an outline drawing. In FIG. 2, a part of the structural components of the image forming device according to the present exemplary embodiment is shown as a perspective drawing.

As shown in FIG. 1, an image forming device 10 according to the present exemplary embodiment is provided with a device main body 12 that houses each structural part of the image forming device 10. A paper supply tray 14 that houses paper P as a recording medium is arranged in the lower portion of the device main body 12.

A feed roll 16 is arranged directly above the leading edge side of this paper supply tray 14 (the left-end side in FIG. 1). The feed roll 16 contacts the leading edge side of the upper surface of the paper P, rotates, and sends out the paper P from the paper supply tray 14.

Further, a conveying route 22 is formed at the device main body 12, and the paper P sent out from the paper supply tray 14 is conveyed by this conveying route 22. The conveying route 22 extends from the leading edge portion of the paper supply tray 14, through an image forming section 18 that is in the central portion of the device main body 12, and up to a discharge tray 23 attached to the device main body 12.

The image forming section 18 is provided with a photosensitive drum 30 that rotates in a preset direction (in FIG. 1, in the counterclockwise direction). In the area surrounding the photosensitive drum 30, the following are each provided in order from the upstream side of the direction of rotation of the photosensitive drum 30: a charging device (not shown) that charges a surface of the photosensitive drum 30; an exposing device (not shown) that exposes the surface of the charged photosensitive drum 30 and forms an electrostatic latent image on the surface thereof; and a developing device (also not shown) that makes toner adhere to the electrostatic latent image formed on the surface of the photosensitive drum 30 and develops it.

A transferring device 38 that sandwiches the conveying route 22 is provided beneath the photosensitive drum 30 so as to face it. The transferring device 38 transfers the toner image formed on the surface of the photosensitive drum 30 to the paper P at a preset transfer-position.

A registering section 20 is also provided along the conveying route 22 between the image forming section 18 and the feed roll 16. The registering section 20 corrects skewing (i.e., slanting) of the paper P sent out from the paper supply tray 14 with pairs of registering rollers 20A and 20B and sends the paper P into the transfer-position at preset timing.

A fixing device 40 that makes the transferred toner image fix to the paper P and a pair of discharging rolls 44 that discharges the paper P to the discharge tray 23 are arranged along the conveying route 22 at the downstream side of the image forming section 18.

A reverse and discharge section 26 that makes the paper P reverse when the paper P is discharged to the discharge tray 23 is provided between the fixing device 40 and the pair of discharging rolls 44 (refer to FIG. 2). A reverse conveying route 28 is formed at the reverse and discharge section 26 between the fixing device 40 and the pair of discharging rolls 44 as a conveying route connected to the conveying route 22.

As shown in FIGS. 1 and 2, this reverse conveying route 28 is provided so as to extend downward and in the horizontal direction at the lower portion of the device main body 12. A first claw piece 24 that determines the conveying route of the paper P is provided at a branch point between the conveying route 22 and reverse conveying route 28. The first claw piece 24 swings downward (the chain double-dashed line position in FIG. 1) to close the reverse conveying route 28, and open the conveying route 22, whereby paper P on which the toner image is fixed is led to the pair of discharging rolls 44. The paper P led to the pair of discharging rolls 44 is discharged to the discharge tray 23 by the pair of discharging rolls 44 as is without being reversed.

The first claw piece 24 swings upward to close the conveying route 22 and open the reverse conveying route 28, whereby the paper P on which the toner image is fixed is led to the reverse conveying route 28.

A pair of conveying rolls 33 is provided at the reverse conveying route 28, and the paper P led to the reverse conveying route 28 is sent into reversing rolls 32 by the pair of conveying rolls 33.

The reversing rolls 32 send the paper P once to the downstream side of the reverse conveying route 28 and reversely rotate, thereby making the paper P switchback. Note that with the present exemplary embodiment, a part of the reverse conveying route 28 which is at the downstream side of the reversing rolls 32 is referred to as a reverse conveying path 28A.

A reverse and discharge conveying route 36 for sending the reversed paper P to the pair of discharging rolls 44 is connected to the reverse conveying route 28. A pair of conveying rolls 35 that conveys the paper P to the pair of discharging rolls 44 is provided at the reverse and discharge conveying route 36. Note that in FIG. 1, only one of the pair of conveying rolls 35 is shown.

A double-side conveying route 34 for sending back the paper P again on which an image is formed on one surface to the conveying route 22 is connected to the reverse conveying route 28. As shown in FIG. 2, the double-side conveying route 34 is formed such that paper guides 42 that guide the paper P are arranged along the conveying route. Plural pairs of conveying rolls 39 (three in the present exemplary embodiment) that convey the paper P to the conveying route 22 are provided at the double-side conveying route 34. In FIG. 1, the conveying rolls 39 are shown with a portion thereof omitted.

A second claw piece 37 that determines the conveying route of the paper P is provided at a branch point between this double-side conveying route 34 and the reverse conveying route 28.

The second claw piece 37 swings downward (the chain double-dashed line position in FIG. 1) to close the double-side conveying route 34, and open the reverse and discharge conveying route 36, whereby the paper P switch-backed from the reverse conveying path 28A is led to the reverse and discharge conveying route 36. The paper P led to the reverse and discharge conveying route 36 is conveyed to the pair of discharging rolls 44 by the pair of conveying rolls 35 provided at the reverse and discharge conveying route 36. The paper P conveyed to the pair of discharging rolls 44 is discharged on the discharge tray 23 by the pair of discharging rolls 44 in a state of the top and under surfaces being reversed.

Further, the second claw piece 37 swings upward to close the reverse and discharge conveying route 36, and open the double-side conveying route 34, whereby the paper P switch-backed from the reverse conveying path 28A is led to the double-side conveying route 34. The paper P led to the double-side conveying route 34 is sent into the registering section 20 and a toner image is again transferred, by the image forming section 18, on the one surface side where the image is not formed. Then the transferred toner image is fixed to the paper P by the fixing device 40 and the paper P is discharged to the discharge tray 23 by the pair of discharging rolls 44.

As explained above, the conveying route of the image forming device 10 includes: the conveying route 22 that extends from the front edge portion of the paper supply tray 14 and reaches the discharge tray 23 through the image forming section 18; the reverse conveying route 28 that is connected to the conveying route 22 and that extends downward and in the horizontal direction at the lower portion of the device main body 12; the reverse conveying path 28A, which is a part of the reverse conveying route 28 further at the downstream side than the reversing roll 32; the reverse and discharge conveying route 36 that is connected to the reverse conveying route 28 and that is for sending the paper P to the pair of discharging rolls 44; and the double-side conveying route 34 that is connected to the reverse conveying route 28 and that is for sending the paper P back again to the conveying route 22.

Configuration of the Pullout Unit According to the Present Exemplary Embodiment

A pullout unit 50 according to the present exemplary embodiment is a unit that can be pulled out of and pushed in to the device main body 12, and is provided with a pullout unit main body 52 as a pullout component provided so it can be pulled out from the device main body 12. Note that in FIG. 3, the pullout unit 50 is shown in a state where it is accommodated in the device main body 12, and in FIG. 4, the pullout unit 50 is shown in a state where it has been pulled out from the device main body 12.

The pullout unit main body 52 is configured so that it is pulled out in a direction perpendicular to the direction in which the paper P is conveyed, with a pullout mechanism that is formed from, e.g., a rail component and the like (not shown). Note that the pullout direction of the pullout unit main body 52 is not thus limited and can also be made so that, for example, its direction follows the direction in which the paper is conveyed.

A frame 53 that supports each of the structural parts is provided in the pullout unit main body 52. The frame 53 supports the registering section 20, the transferring device 38, the fixing device 40, the reverse and discharge section 26, the reverse conveying route 28, and the double-side conveying route 34 that act as each of the structural parts. These structural parts are formed into a unit and are integrally pulled out from and inserted into the device main body 12. Note that the dotted line portion of FIG. 1 is the portion that forms the pullout unit 50.

Figure 3:
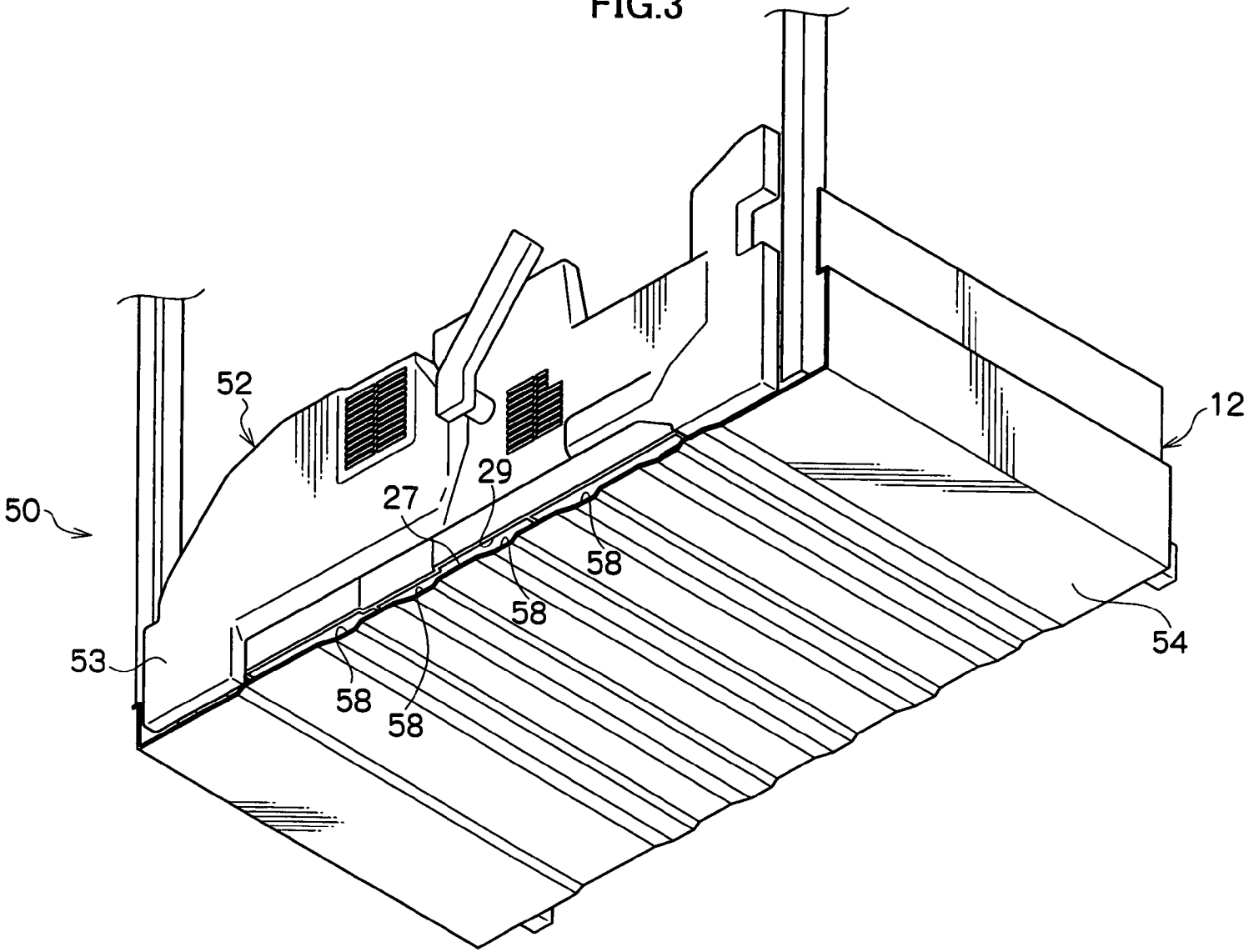
FIG. 3 is a perspective drawing showing a state where a pullout unit according to the present exemplary embodiment is stored in the main body of the device.
Figure 4:
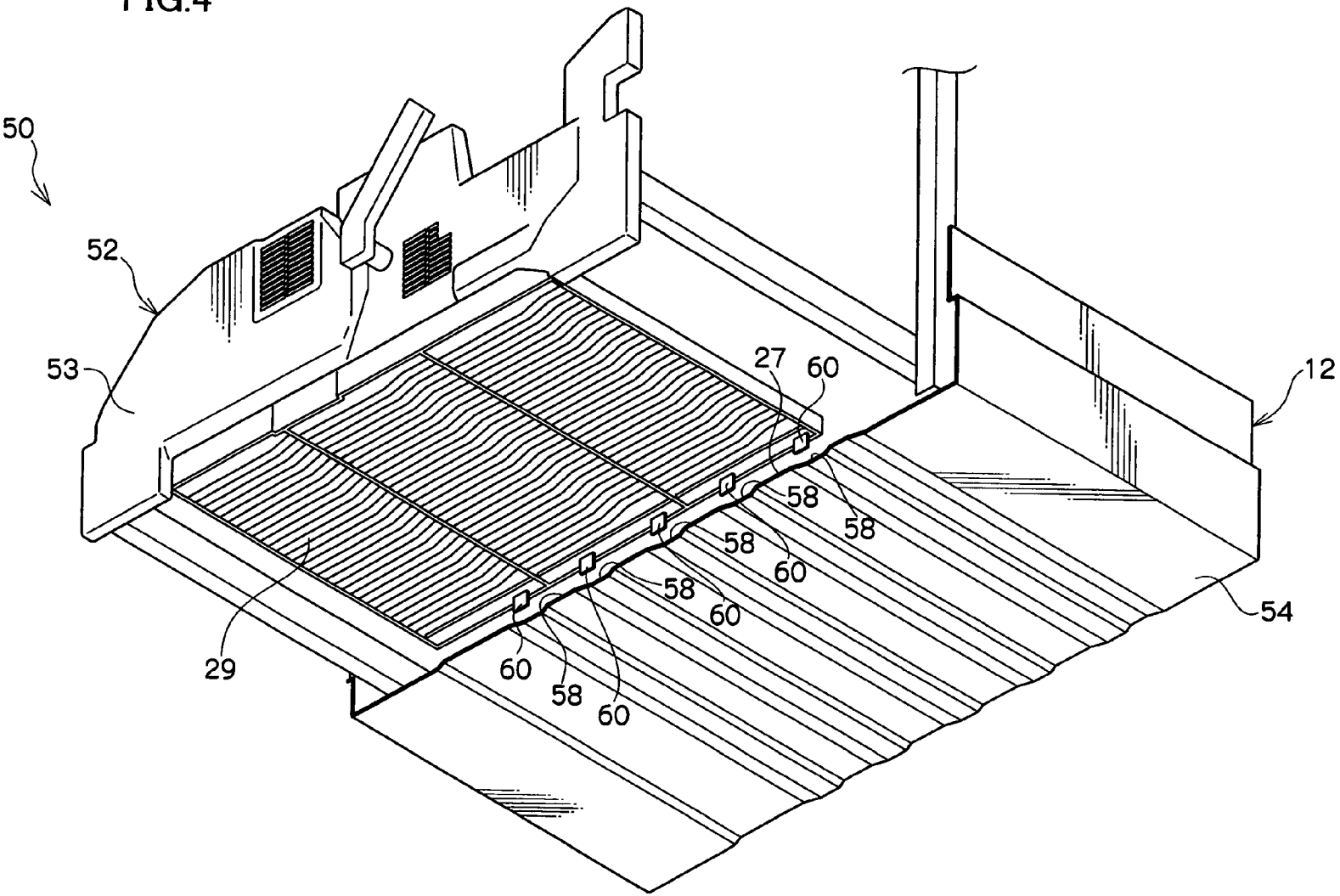
FIG. 4 is a perspective drawing showing a state where the pullout unit according to the present exemplary embodiment is pulled out from the main body of the device.

As shown in FIGS. 3 and 4, a bottom plate 54 that serves as a bottom panel structuring the frame of the device main body 12 is provided under the pullout unit main body 52. This bottom plate 54 structures a conveying route surface 27 of the reverse conveying path 28A at the device main body 12 side.

A conveying route surface 29 that faces the conveying route surface 27 is formed on a lower surface of the pullout unit main body 52. The reverse conveying path 28A is configured with this conveying route surface 29 and the conveying route surface 27.

Rubber members 60 are provided at the inner side of pullout direction of the pullout unit main body 52. This rubber member 60 is provided as a scraping member that scrapes out the paper P on the conveying route surface 27 when the pullout unit main body 52 is pulled out. The term "inner side" in this case means a side that is further from an operator, in the pull out direction, at the time when the pullout unit main body 52 is pulled out by the operator.

The rubber member 60 is formed from panel-shaped rubber and an area of the portion that is in contact with the paper P is adjusted. Also, the rubber member 60, when compared to materials such as resin and the like, has higher friction with the paper P so the effect of catching on the paper P is increased. Further, plural rubber members 60 are arranged at intervals narrower than the smallest size paper P conveyed on the reverse conveying path 28A.

Figure 5:
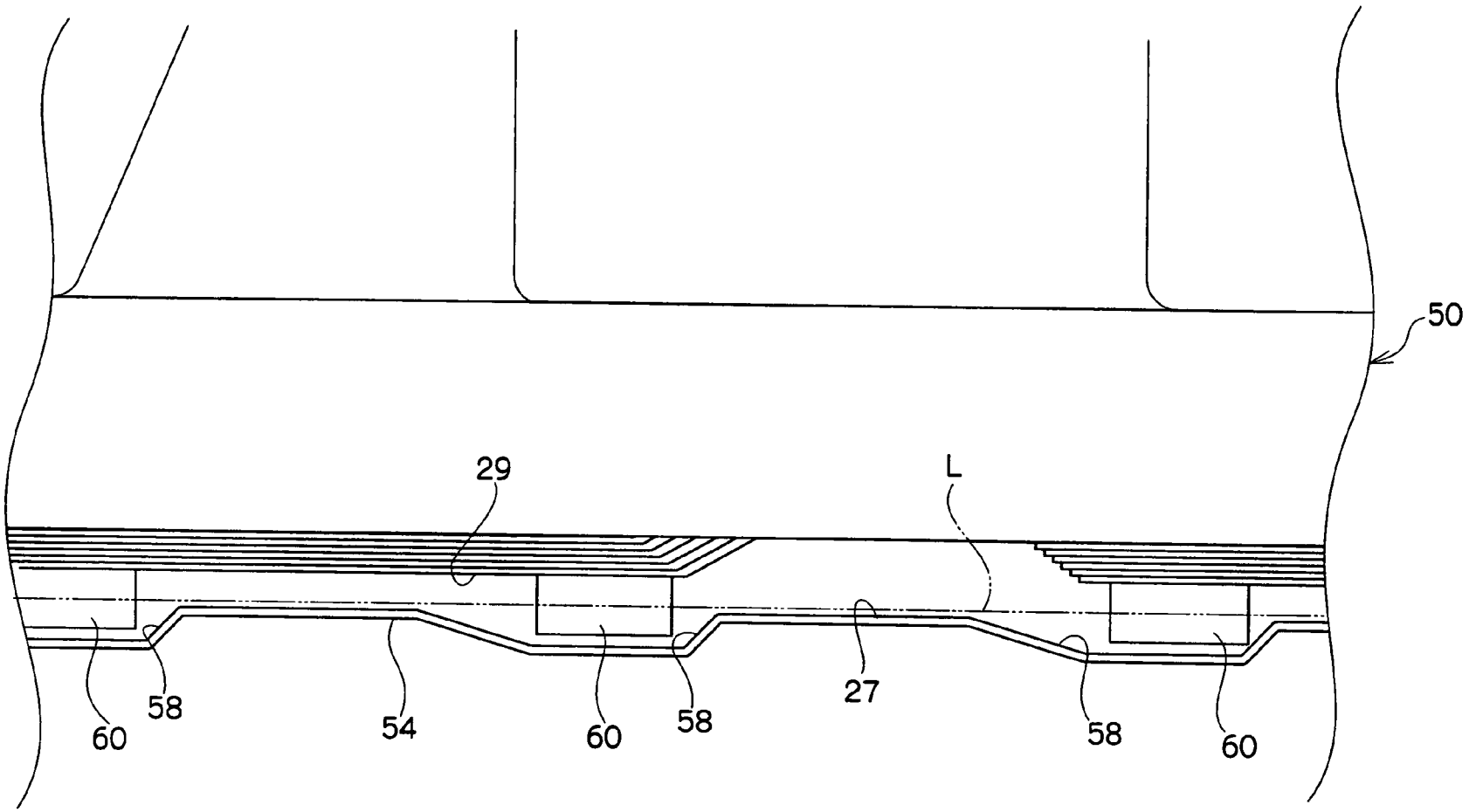
FIG. 5 is a side surface drawing showing a rubber member provided in the pullout unit according to the present exemplary embodiment.

As shown in FIG. 5, concave portions 58 are formed in the conveying route surface 27 at the bottom plate 54 of the device main body 12. Due to the concave portions 58, spaces are formed at portions lower than the position L through which the paper P passes.

Each rubber member 60 is arranged in the concave portion 58 and is designed so as to enter into the space formed by the concave portion 58. Due to the rubber member 60 entering into the space formed by the concave portion 58, the amount of protrusion of the rubber member 60 protruding further downward than the position L through which the paper P passes is increased. Due to this, not the bottom end portion of the rubber member 60 but the central portion of the rubber member 60 comes into contact with the paper P.

Operation of the Present Exemplary Embodiment

Next, the operation of the above-described exemplary embodiment will be explained.

In the configuration of the present exemplary embodiment, when the pullout unit 50 is pulled out from the device main body 12, the rubber members 60 provided at the inner side in the pullout direction of the pullout unit main body 52 scrape out the paper P remaining on the reverse conveying path 28A.

Due to this, the paper P remaining on the reverse conveying path 28A which is formed with the conveying route surface 27 of the device main body 12 and the conveying route surface 29 of the pullout unit 50 can be easily taken and removed.

Also, in the configuration of the present exemplary embodiment, plural rubber members 60 are arranged at intervals narrower than the smallest sized paper P conveyed on the reverse conveying path 28A. Accordingly, even if the paper P remaining on the reverse conveying path 28A is the smallest sized paper, it can be removed.

Also, in the configuration of the present exemplary embodiment, the rubber members 60 enter into the concave portions 58 formed in the conveying route surface 27 of the device main body 12 along the direction in which the pullout unit 50 is pulled out. Accordingly, the scraping-out effect, where it is easier for the rubber members 60 to catch on the paper P remaining on the conveying route surface 27, is heightened.

Figure 6:
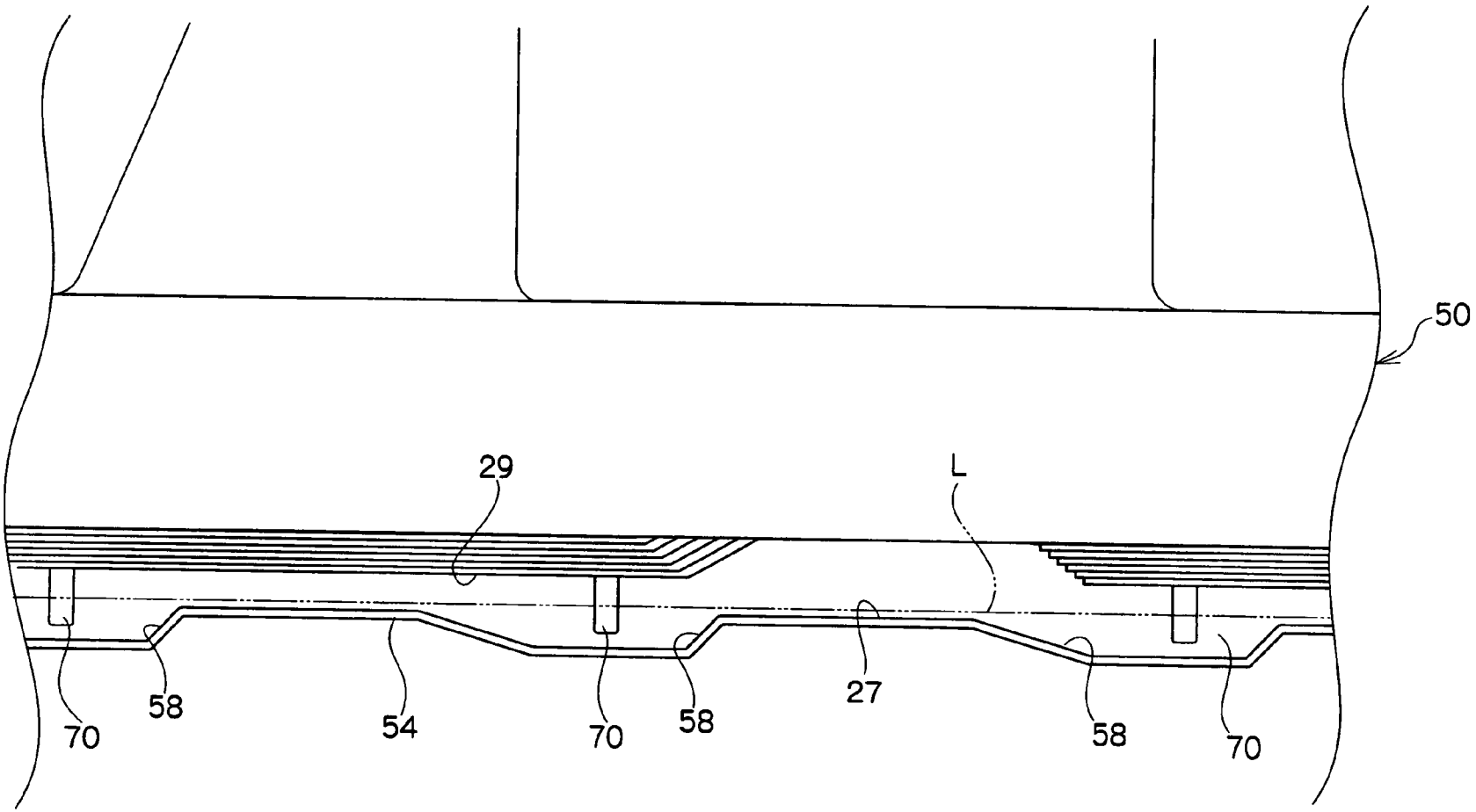
FIG. 6 is a side surface drawing showing a resin component provided in the pullout unit according to the present exemplary embodiment.

Note that the scraping member is not limited to the rubber member 60. As shown in FIG. 6, these can also be cylindrical resin components 70 integrally formed with the pullout unit main body 52.

Figure 7:
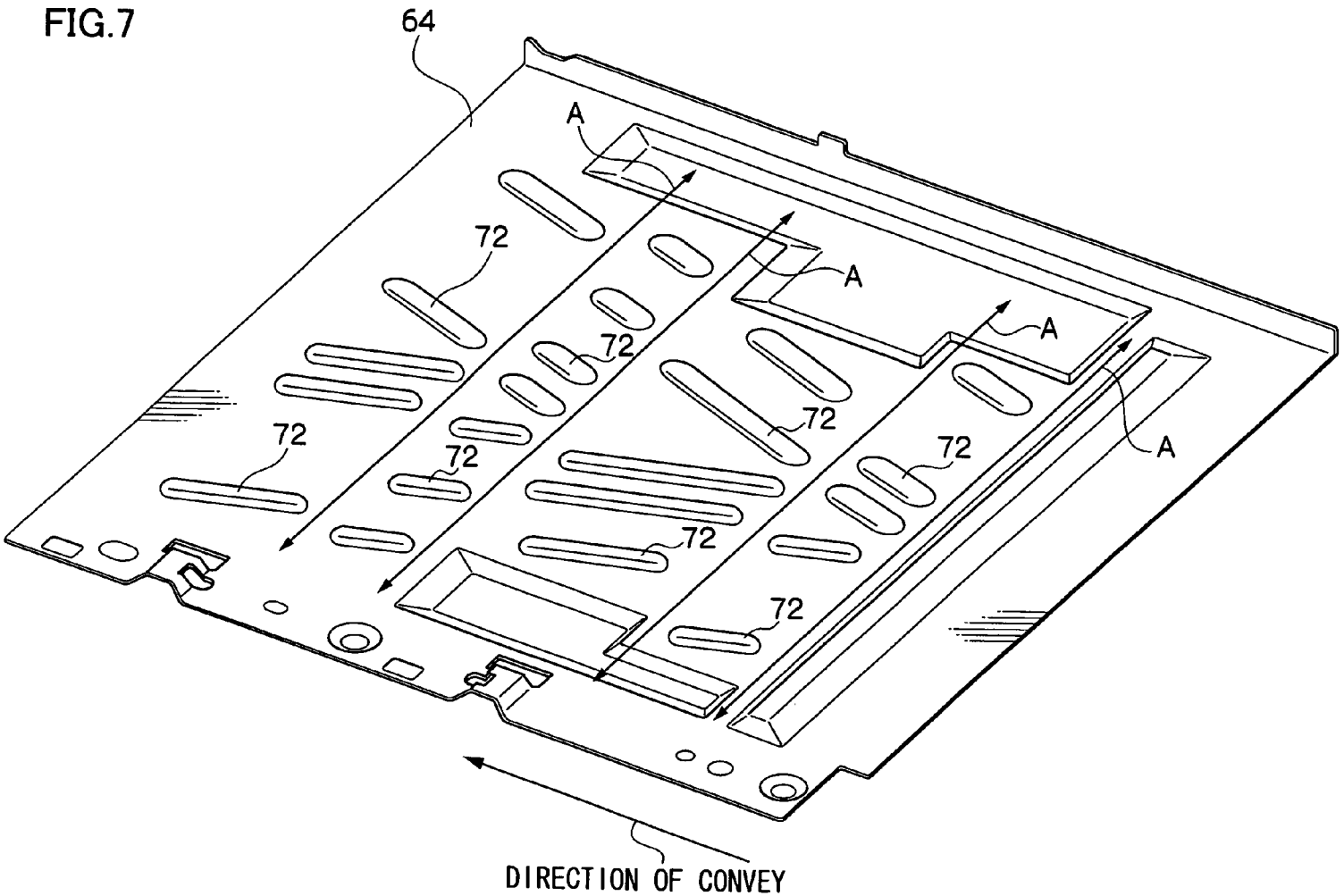
FIG. 7 is a perspective drawing showing an alternate example of a bottom plate according to the present exemplary embodiment.

Also, a bottom plate 64 shown in FIG. 7 can be the bottom panel provided in the device main body 12.

With this configuration, plural ribs 72 arranged in the direction perpendicular to the conveying direction are provided. The rib 72 extends at incline relative to the conveying direction, and guides the paper P such that conveying resistance is not generated on the conveyed paper P.

The ribs 72 are arranged at preset intervals along the conveying direction. By forming the protruding ribs 72, concave portions into which the rubber members 60 enter are formed between the ribs 72.

The rubber members 60 pass through concave portions one step lower than the position through which the paper P passes, and can catch on the paper P with certainty. Note that in FIG. 7, the positions through which the rubber members 60 pass are shown with the A arrow.

Also, with this configuration, the conveyed paper P is guided by the ribs 72 so the area that is in contact with the paper P can be diminished. Accordingly, dirtying of the paper P due to toner stuck on the bottom plate 64 can be prevented.

Note that in the above-described exemplary embodiment, the conveying route formed by the conveying route surface of the device main body side and the conveying route surface of the pullout unit side being faced is the reverse conveying path 28A where the paper P is switched back. Nonetheless, the present invention is not thus limited. For example, this can be a conveying path through which the paper P passes, as long as it is a conveying route where the paper P is conveyed.

Also, in the above-described exemplary embodiment, the conveying route surface of the pullout unit side, facing the conveying route surface of the device main body side, is formed in the lower surface of the pullout unit 50. Nonetheless, the present invention is not thus limited. This can be configured to be formed on the side surface or the upper surface of the pullout unit 50.

The present invention is not limited to the present exemplary embodiment and various alternatives, changes, and improvements are possible.

What is claimed is:

1. A pullout unit comprising:

a pullout component that is provided at a main body of a device so as to be able to be pulled out from the main body of the device, and that faces a conveying route surface of the main body of the device to form a conveying route on which an object to be conveyed is conveyed; and a scraping member that is provided at one of end portions of a conveying route surface of the pullout component in a pullout direction in which the pullout component is pulled out at the pullout component, the one of end portions being further toward an inner side in the pullout direction and that scrapes the object to be conveyed on the conveying route surface when the pullout component is pulled out such that the conveying route surface of the pullout component is relatively moved with respect to the conveying route surface of the main body of the device.

2. The pullout unit of claim 1, wherein a plurality of the scraping members are arranged at intervals narrower than the smallest size of the object to be conveyed which is conveyed on the conveying route.

3. The pullout unit of claim 1, wherein the scraping member is provided so as to protrude from a conveying route surface of the pullout component toward the conveying route surface of the main body of the device.

4. The pullout unit of claim 3, wherein a protruding amount of the scraping member is set such that the scraping member protrudes further than a position at which the object to be conveyed is conveyed on the conveying route, toward the conveying route surface of the main body of the device.

5. The pullout unit of claim 2, wherein the scraping members are arranged along a conveying direction in which the object to be conveyed is conveyed on the conveying route, and the pullout direction of the pullout component is perpendicular to the conveying direction.

6. An image forming device comprising:

a pullout unit comprising a pullout component that is provided at a main body of the image forming device so as to be able to be pulled out from the main body, and that faces a conveying route surface of the main body to form a conveying route on which a recording medium is conveyed, and a scraping member that is provided at one of end portions of a conveying route surface of the pullout component in a pullout direction in which the pullout component is pulled out at the pullout component, the one of end portions being further toward an inner side in the pullout direction and that scrapes the object to be conveyed on the conveying route surface when the pullout component is pulled out such that the conveying route surface of the pullout component is relatively moved with respect to the conveying route surface of the main body of the device; and a concave portion that is formed in the conveying route surface along the pullout direction of the pullout component and into which the scraping member enters.

7. The image forming device of claim 6, wherein a plurality of the scraping members are arranged at intervals narrower than the smallest size of the recording medium which is conveyed on the conveying route, and a plurality of the concave portions are arranged to correspond to the respective scraping members.

8. The image forming device of claim 6, wherein the scraping member is provided so as to protrude from a conveying route surface of the pullout component toward the conveying route surface of the main body of the device.

9. The image forming device of claim 8, wherein a protruding amount of the scraping member is set such that the scraping member protrudes further than a position at which the recording medium is conveyed on the conveying route, toward the conveying route surface of the main body.

10. The image forming device of claim 7, wherein the scraping members are arranged along a conveying direction in which the recording medium is conveyed on the conveying route, and the pullout direction of the pullout component is perpendicular to the conveying direction.

11. The image forming device of claim 6, wherein a plurality of ribs are formed at the conveying route surface of the main body, and a space between the ribs serves as the concave portion.

12. The image forming device of claim 6, wherein the conveying route surface of the main body of the device is formed on an upper surface of a bottom plate of the main body, and the conveying route surface of the pullout component is formed on a lower surface of the pullout unit.

13. The image forming device of claim 6, wherein the conveying route is a part of a conveying route at which the recording medium is reversed.

14. The pullout unit of claim 1, wherein a plurality of the scraping members are arranged at the inner side of the pullout unit with respect to the pullout direction so as to be adjacent the conveying route and absent from the conveying route when the pullout unit is inserted in the main body.

15. The pullout unit of claim 1, wherein the scraping member includes a panel-shaped rubber member.

16. The pullout unit of claim 1, wherein the scraping member includes a cylindrical resin component.

17. The image forming device of claim 6, wherein a plurality of the scraping members are arranged at the inner side of the pullout unit with respect to the pullout direction so as to be adjacent the conveying route and absent from the conveying route when the pullout unit is inserted in the main body.

18. The forming device of claim 6, wherein the scraping member includes a panel-shaped rubber member.

19. The forming device of claim 6, wherein the scraping member includes a cylindrical resin component.

20. A pullout unit comprising:

a pullout component that is provided at a main body of a device so as to be able to be pulled out from the main body of the device, and that faces a conveying route surface of the main body of the device to form a conveying route on which an object to be conveyed is conveyed; and a scraping member that is provided at the pullout component at the inner side in a pullout direction in which the pullout component is pulled out, and that scrapes the object to be conveyed on the conveying route surface when the pullout component is pulled out, wherein the scraping member includes a panel-shaped rubber member.

* * * * *